United States Patent [19]

Hess

[11] Patent Number: 4,502,192

[45] Date of Patent: Mar. 5, 1985

[54] SEPARABLE FASTENER

[76] Inventor: Herman A. Hess, 10 Eddystone Ave., Downsview, Canada, M3N 1H4

[21] Appl. No.: 513,825

[22] Filed: Jul. 15, 1983

[51] Int. Cl.[3] ..... A44B 19/00

[52] U.S. Cl. ..... 24/590; 24/701

[58] Field of Search ..... 24/589, 590, 591, 701

[56] References Cited

U.S. PATENT DOCUMENTS

| | | | |
|---|---|---|---|
| 104,622 | 6/1870 | Merlett | 24/590 X |
| 1,494,610 | 5/1924 | McGlashan | 24/701 X |
| 1,840,896 | 1/1932 | Groh | 24/701 |
| 3,751,770 | 8/1973 | Italiano | 24/701 X |
| 4,399,594 | 8/1983 | Ostermaier | 24/589 |

FOREIGN PATENT DOCUMENTS

| | | | |
|---|---|---|---|
| 806004 | 6/1951 | Fed. Rep. of Germany | 24/701 |
| 6709 | of 1908 | United Kingdom | 24/701 |

*Primary Examiner*—William E. Lyddane
*Assistant Examiner*—Peter A. Aschenbrenner
*Attorney, Agent, or Firm*—Sim & McBurney

[57] ABSTRACT

A separable fastener is provided, consisting of a male member with a stem portion and a T-shaped head portion, and a female member in the shape of an elongated body having a tail portion and a forward portion that is bent with respect to the tail portion. The body has an opening adjacent the bent portion, the opening of sufficient length to permit insertion of one arm of the T-shaped head portion of the male member. The bent forward portion of the female member terminates at an edge which interferes with complete passage of the T-shaped head portion through the opening in any but one particular orientation of the male member with respect to the female member. The edge has an indentation which is adapted to receive the T-shaped head portion when the male member is in that particular orientation, thus permitting the avoidance of interference and a complete passage of the T-shaped head portion through the opening. The opening also has a part wide enough to permit swivelling of the stem portion of the male member after passage of the T-shaped head portion through the opening.

8 Claims, 6 Drawing Figures

SEPARABLE FASTENER

This invention relates to improvements in separable fasteners, and has particular reference to a fastener for use with necklaces and similar items of personal adornment.

BACKGROUND OF THIS INVENTION

Currently the most commonly utilized fastener for necklaces and the like consists of a combination of two rings, the one ring being integral and being attached to one end of the necklace or chain, the other ring consisting of a tubular penannular portion defining a gap through which the integral ring can pass, the penannular portion housing a slidable latch portion which is spring biased in such a way that it closes the penannular portion under the urging of the spring. However, the latch portion can be pulled back to allow the integral ring to be passed into or out of engagement with the penannular portion. This conventional fastener works well enough, but is expensive to manufacture and is subject to sticking and breakage due to the moving parts.

A different approach to joining the ends of a garment accessory is illustrated in U.S. Pat. No. 1,840,896, Groh, and in U.S. Pat. No. 499,225, Hayes. Both of these fasteners are intended for use with a belt-like article in which, after connection together, the parts of the fastener are constantly tensioned together. However, the structure of these prior art fasteners, quite similar to each other, is not appropriate for use with a necklace or other loose article of adornment, in which the parts of the fastener are likely to be bounced around and are not under constant tension to keep them together.

The Groh and Hayes prior fasteners are constituted by a T-shaped male member and a female member with a slot through which the male member may be inserted, then rotated, then pulled into tension so that the members cannot be disengaged.

The present invention utilizes the same basic structure, but adds an additional improved feature which prevents the parts of the fastener, once engaged, from being simply bounced or jiggled into disengagement.

GENERAL DESCRIPTION OF THIS INVENTION

More particularly, this invention provides a separable fastener which includes a male member having a stem portion and a T-shaped head portion with two arms projecting sidewards from the stem portion, and a female member constituted by an elongated body with a tail portion and a forward portion that is bent with respect to the tail portion. The elongated body of the female member has an opening adjacent the bent forward portion, the opening being of sufficient length to permit the insertion of one arm of the T-shaped head portion of the male member. However, the bent forward portion of the female member terminates at an edge which interferes with complete passage of the T-shaped head portion through the opening in any but one particular orientation of the male member with respect to the female member. That edge has an indentation adapted to receive the T-shaped head portion when it is in said one particular orientation, in order to avoid interference and permit complete passage of the T-shaped head portion through the opening. The opening further has a part wide enough to permit swivelling of the stem portion after passage of the T-shaped head portion through the opening.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
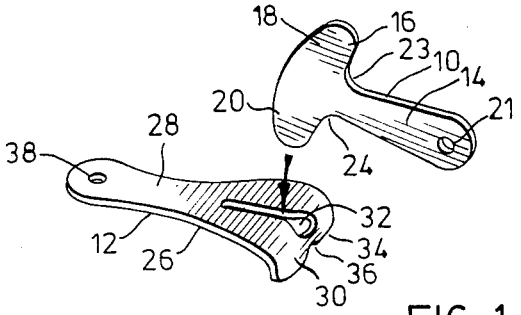
FIG. 1 is a perspective view of the two parts of the separable fastener of this invention, just prior to connection.

Attention is first directed to FIG. 1, which shows a male member 10 and a female member 12. The male member 10 has a stem portion 14 and a T-shaped head portion 16, the head portion 16 having two arms 18 and 20 projecting sidewards from the stem portion 14. It will be seen that the male member is bilaterally symmetrical about a mid-line of symmetry, and that the stem portion 14 has an aperture 21 on the mid-line of symmetry.

At the location of transition between the arms 16 and 20 and the stem portion 14 are two shoulders 23 and 24, which are rounded as can be seen in the figure.

The female member 12 is constituted by an elongated body 26 having a tail portion 28 and a forward portion 30 that is bent with respect to the tail portion 28. The elongated body 26 has an opening 32 therethrough adjacent the bent portion 30, the opening 32 being of sufficient length to permit insertion of one arm 20 of the T-shaped head portion 16 of the male member 10. As can be seen, the bent forward portion 30 of the female member 12 terminates at an edge 34 which includes an inward indentation 36.

The female member 12 is bilaterally symmetrical about a mid-line of symmetry, and both the opening 32 and the indentation 36 are located on that mid-line of symmetry. The tail portion 28 has an aperture 38 also on the mid-line of symmetry.

If the indentation 36 were absent on the edge 34, it would not be possible to insert the male member 10 fully through the opening 32, due to mechanical interference between the male member 10 and the edge 34. However, the provision of the indentation 36 allows the male member 10 to be pushed through the opening 32, so long as the male member 10 registers with and is received within the indentation 36 during the last portion of its passage.

Figure 2:
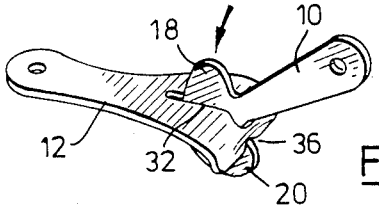
FIG. 2 is a perspective view of the first step in the connection together of the two parts.
Figure 6:
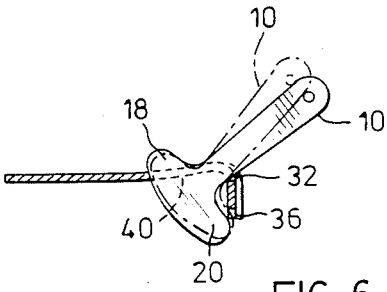
FIG. 6 is a sectional view through the female member, illustrating the critical positioning of the male member during attachment and detachment.

To make this clearer, attention is directed to FIG. 2, in which the one arm 20 of the male member 10 has passed through the opening 32. In FIG. 2, the male member 10 is shown in registry with the indentation 36, and this arrangement corresponds substantially with the broken line position of the male member shown in FIG. 6. The slight extra accommodation of the male member 10 permitted by the presence of the indentation 36 allows the other arm 18 to pass through the opening 32. In FIG. 6 the location of the slot which is hidden by the member 10 is shown in dotted line at 40.

By contrast, the solid line position of the male member 10 in FIG. 6 represents a position in which the male member is slightly angulated away from being in line with the indentation 36, so that it does not register with that indentation. Instead, it comes to rest to one side or the other of the indentation 36, and in this position there is insufficient accommodation of the arm 20 to permit complete passage of the arm 18, and disengagement of the two members is impossible.

Figure 3:
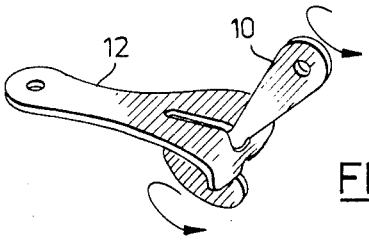
FIG. 3 is a perspective view of the following step in the connection together of the two parts, showing rotation of the one with respect to the other.
Figure 4:
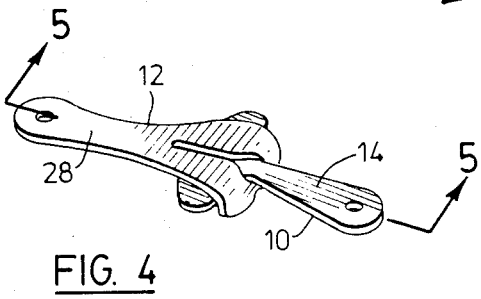
FIG. 4 is a perspective view of the two parts in the final assembled condition.
Figure 5:
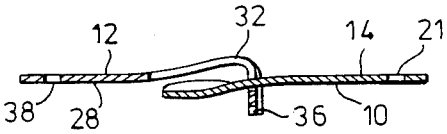
FIG. 5 is a sectional view taken at the line 5—5 in FIG. 4.

After the arm 18 has passed through the opening 32, the male member 10 can be swivelled through approximately 90° due to the fact that the opening 32 has a part adjacent the bent portion 30 which is large enough to permit the swivelling shown in FIG. 3. After swivelling, the male and female members will be in the aligned position shown in FIG. 4 such that the tail portion 28 of the female member 12 and the stem portion 14 of the male member 10 are parallel and approximately in the same plane. This condition is shown in FIG. 5.

It will now be appreciated that the chances of the two members being jiggled or bounced loose when connecting the ends of a chain or necklace are extremely small, for the reason that the male member 10 would have to take up the position shown in broken lines in FIG. 6, in which it is engaged with the indentation 36, and in which the arm 18 is already partly through the opening 32. Any other configuration would not allow disengagement. The likelihood of the male member 10 taking up this position purely by chance through jiggling or bouncing is extremely remote.

However, the wearer of a necklace joined by this fastener, with very little practice, can quickly learn to engage or disengage the fastener without looking at it.

It will be noted that the outer edge of the T-shaped head portion 16 is rounded, and it will be understood that this is done to facilitate the action illustrated in FIG. 6.

Furthermore, it is to be emphasized that the male member 10 is sized with respect to the opening 32 in such a way that it almost passes through the opening 32 regardless of registry with the indentation 36, but not quite. It requires the extra accommodation of the indentation 36 to allow complete passage. Preferably, even when the member 10 is in registry with the indentation 36, the arm 18 will be a "touch fit" against the end of the opening 32 which is remote from the bent portion 30. Thus, some slight pressure must be exerted on the male member 10 to cause it to pass completely through the opening 32, even when it is in registry with the indentation 36. This provides a further safeguard against accidental disengagement of the fastener.

While one embodiment of this invention has been illustrated in the accompanying drawings, and described hereinabove, it will be evident to those skilled in the art that changes and modifications may be made therein, without departing from the essence of this invention as set forth in the appended claims.

I claim:

1. A separable fastener comprising:

a male member having a stem portion and a T-shaped head portion with two arms projecting sidewards from the stem portion, and a female member constituted by an elongated body with a tail portion and a forward portion that is bent with respect to the tail portion, the elongated body having an opening therethrough adjacent the bent forward portion, the opening being of sufficient length to permit insertion of one arm of said T-shaped head portion of the male member, said bent forward portion of the female member terminating at an edge which interferes with complete passage of the T-shaped head portion through the opening in any but one particular orientation of the male member with respect to the female member, said edge having an indentation adapted to receive the T-shaped head portion when in said one particular orientation in order to avoid interference and permit complete passage of the T-shaped head portion through the opening, the opening further having a part wide enough to permit swivelling of the stem portion after passage of the T-shaped head portion through the opening.

2. The fastener claimed in claim 1, in which the male member is substantially flat and the female member is shaped by bending a substantially flat stamping.

3. The fastener claimed in claim 1, in which both members are bilaterally symmetrical, the said indentation being on the mid-line of symmetry of the female member.

4. The fastener claimed in claim 1, in which the outer edge of the T-shaped head portion remote from the stem portion is rounded.

5. The fastener claimed in claim 1, in which each of the male and female members has an aperture for connection to a chain or the like.

6. The fastener claimed in claim 2, in which the bend in the forward portion of the female member is a rounded bend, thereby enhancing the springiness of the forward portion, and allowing an interference fit with respect to the male member, so that positive force is required to push the male member into, or retract it from the female member.

7. The fastener claimed in claim 6, in which both members are bilaterally symmetrical, the said indentation being on the mid-line of symmetry of the female member.

8. The fastener claimed in claim 7, in which the outer edge of the T-shaped head portion remote from the stem portion is rounded, and in which each of the male and female members has an aperture for connection to a chain or the like.

* * * * *